US006909427B2

(12) United States Patent
Janssen et al.

(10) Patent No.: US 6,909,427 B2
(45) Date of Patent: Jun. 21, 2005

(54) LOAD ADAPTIVE COLUMN DRIVER

(75) Inventors: Peter J. Janssen, Scarborough, NY (US); Lucian Remus Albu, New York, NY (US); John Dean, Stormville, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 229 days.

(21) Appl. No.: 10/165,881

(22) Filed: Jun. 10, 2002

(65) Prior Publication Data

US 2003/0227448 A1 Dec. 11, 2003

(51) Int. Cl.[7] ..... G09G 3/30

(52) U.S. Cl. ..... 345/204; 345/87; 345/98; 345/99; 345/100; 315/169.2; 315/169.3; 327/277; 361/152

(58) Field of Search ..... 345/204, 87, 99, 345/100, 98, 214; 315/169.2, 169.3; 327/277; 361/152

(56) References Cited

U.S. PATENT DOCUMENTS 5,021,774 A * 6/1991 Ohwada et al. ..... 345/90
5,812,104 A * 9/1998 Kapoor et al. ..... 345/76
6,067,061 A * 5/2000 Friedman ..... 345/74.1
6,137,432 A * 10/2000 Xiao ..... 341/169
6,249,269 B1 * 6/2001 Blalock et al. ..... 345/97
6,252,567 B1 * 6/2001 Budzelaar ..... 345/55
6,320,565 B1 * 11/2001 Albu et al. ..... 345/98
6,329,974 B1 * 12/2001 Walker et al. ..... 345/98
6,384,817 B1 * 5/2002 Janssen et al. ..... 345/204
6,583,610 B2 * 6/2003 Groom et al. ..... 323/288

* cited by examiner

*Primary Examiner*—Xiao Wu
*Assistant Examiner*—Abbas Abdulselam

(57) ABSTRACT

A column driver system and method for driving a plurality of column drivers in an active matrix display. The system comprises: a register in each column driver for holding a pixel value; a system that generates a shared ramp signal for the plurality of column drivers; a system that samples the shared ramp signal for each possible pixel value; and a load characteristic correction system that adaptively adjusts the shared ramp signal in anticipation of a load error associated with at least one pixel value. The load characteristic correction system comprises: a data collection system that collects pixel data for each of the plurality of column drivers and determines a number of occurrences of all possible pixel values; a load analysis system that identifies error conditions based on the number of occurrences; and a signal modification system that determines a correction to the ramp signal when an error condition is identified.

21 Claims, 2 Drawing Sheets

LOAD ADAPTIVE COLUMN DRIVER

BACKGROUND OF THE INVENTION

1. Technical Field

The present invention relates generally to circuits for driving columns in a display, and more particularly relates to a system and method for adaptively matching a ramp signal to the load characteristics of problematic pixel values in a video display.

2. Related Art

Video display systems have become commonplace in today's electronics marketplace. Laptops, flat screen monitors, televisions, video cameras, digital cameras, personal digital assistants, cell phones, etc., all typically utilize some form of a video display. As the demand for more and more advanced electronic systems continues to grow, the need to provide improved performance for visual displays remains an ongoing challenge.

A typical visual display, such as a liquid crystal display (LCD), is often configured as an active matrix of pixels arranged in a plurality of columns, e.g., up to 1200 or more. Each column includes a "column driver" that is driven by a common or shared signal created by a column driver circuit. During operation of each column driver, data, representing pixel values (e.g., brightness, etc.), is loaded into registers and converted into analog information via a digital-to-analog converter (DAC), which is then displayed. The column driver circuit provides the necessary voltage signal to "drive" the analog information to be displayed for each pixel in the active matrix. A capacitor associated with each pixel location is utilized to maintain the voltage in the pixel for a finite period of time.

Unfortunately, in some display configurations, the column driver signal is subject to varying loads that can result in a mismatch between the signal generator and the load required by the column drivers. When this occurs, horizontal cross talk may result. Accordingly, there exists a need for a column driver system that can address the changing column load characteristics of a display.

SUMMARY OF THE INVENTION

The present invention addresses the above-mentioned problems, as well as others, by providing, in a first aspect, a column driver system that comprises: a plurality of column drivers, each having a register for storing an inputted pixel value; a column driver circuit having a ramp generator for generating a shared ramp signal for the plurality of column drivers; a buffer coupled between the ramp generator and the plurality of column drivers; and a load characteristic correction system for adaptively adjusting the shared ramp signal in anticipation of a load error associated with at least one pixel value.

In a second aspect, the invention comprises: a method for driving a plurality of column drivers in an active matrix display, comprising: loading each of the column drivers with a pixel value from a set of possible pixel values; generating a shared ramp signal for the plurality of column drivers; sampling the shared ramp signal at different times for each possible pixel value; adaptively adjusting the shared ramp signal in anticipation of a load error associated with at least one pixel value.

In a third aspect, the invention provides a column driver system for driving a plurality of column drivers in an active matrix display, comprising: a register in each column driver for storing a pixel value selected from a set of possible pixel values; a system that generates a shared ramp signal for the plurality of column drivers; a system that samples different values of the shared ramp signal for each possible pixel value; and a load characteristic correction system that adaptively adjusts the shared ramp signal in anticipation of a load error associated with at least one pixel value.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Figure 1:
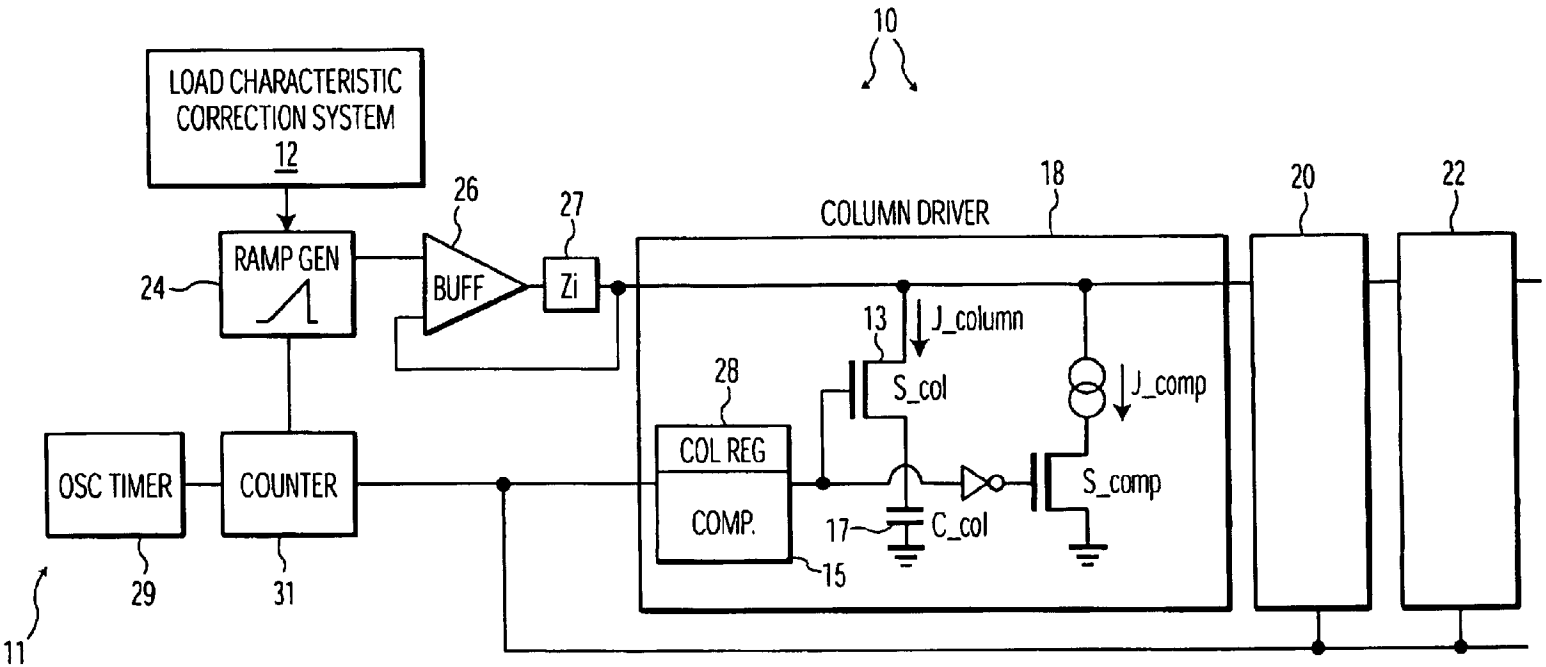
FIG. 1 depicts a column driver system having a ramp signal generator and adaptive load characteristic correction system in accordance with the present invention.

Referring now to the drawings, FIG. 1 depicts a column driver system 10 for driving a video display such as, but not limited to, a liquid crystal display (LCD) panel. Column driver system 10 comprises: a plurality (e.g., up to 1200 or more) of column drivers 18, 20, 22, etc.; a column driver circuit 11 coupled to each of the column drivers; and a load characteristic correction system (LCCS) 12. Each column driver 18, 20, 22 includes a switch 13, a comparator 15, a column register 28, and a pixel capacitance 17. Column driver circuit 11 includes ramp generator 24, buffer 26, feedback 27, oscillator 29, and counter 31.

The general operation of column driver system 10 is as follows. First, pixel data is loaded into a column register 28 for each of the column drivers 18, 20, 22 on a row-by-row basis. Each pixel value dictates some display characteristic, e.g., brightness, gray level, etc., for the pixel. A comparator 15 compares the value in the column register 28 with a counter value generated by oscillator 29 and counter 31. When the values match, switch 13 is triggered, providing a track and hold function that allows a voltage value sampled from the ramp generator 24 to be held and passed to the pixel. The particular voltage value that passes to the pixel is therefore dictated by the pixel value loaded in the column register 28.

Ramp generator 24 generates a ramp signal that is also controlled by oscillator 29 and counter 31. The ramp signal is passed through buffer 26 and feedback 27 before being passed to each of the column drivers 18, 20, 22. Buffer 26 is utilized to unload the ramp signal and isolate the signal from all of the variable loads in the column drivers 18, 20, 22. As noted above, depending on the pixel data in each column register 28, the number of switched or tracking columns will vary. As the number of tracking columns varies, so does the load on buffer 26 that drives the ramp signal. Due to the finite output impedance of the buffer 26, the buffer output signal may deviate from the input in proportion to the load, resulting in horizontal cross talk.

The present invention addresses this problem using load characteristic correction system (LCCS) 12. Namely, LCCS 12 provides a mechanism wherein the ramp signal is adjusted in anticipation of the error caused by a known load, and more particularly a large change between loads. Specifically, by examining the pixel data, the number of column drivers to be switched can be readily pre-calculated for each possible pixel value (and therefore each ramp value). Then, the ramp signal can be adjusted to cancel out the effects of any problematic transient activities, such as large load changes.

Figure 2:
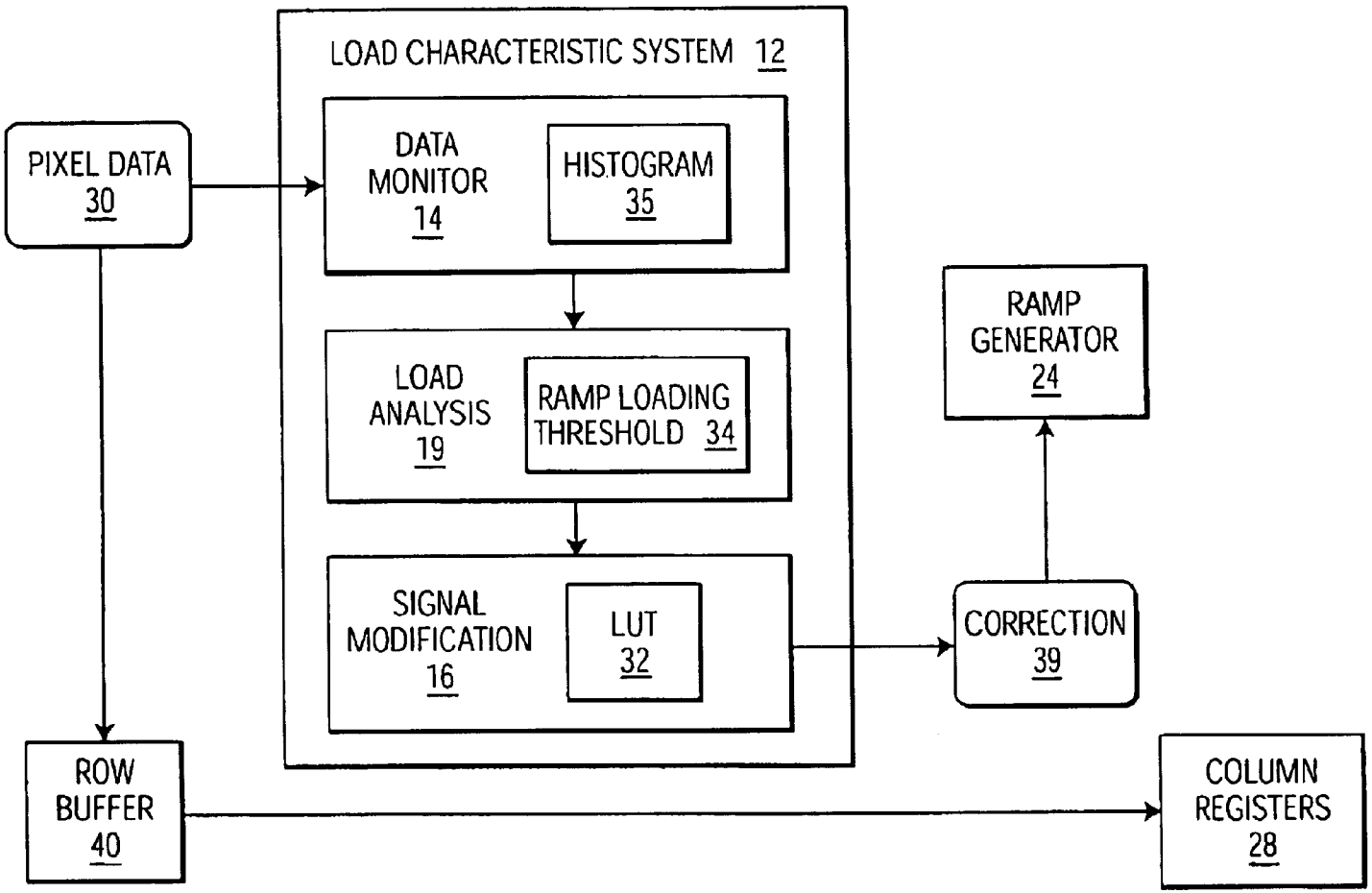
FIG. 2 depicts a more detailed view of the load characteristic correction system of the present invention.

Referring to FIG. 2, a detailed view of LCCS 12 is shown. LCCS 12 receives pixel data 30 and outputs a correction 39, which is passed to ramp generator 24. In an exemplary embodiment, LCCS 12 processes a row of pixel data 30 before the pixel data 30 is loaded into the column registers 28. To achieve this, the processing time of LCCS 12 may comprise one row period, so that the correction can be applied to the row of pixel data during the next row period. A row buffer 40 is utilized to delay display of the row of pixel data for a row period so that LCCS can apply the correction 39 as the row of data is read out of the row buffer 40. Thus, the processing cycle of LCCS 12 is performed in a pipeline fashion whereby each new row is processed while the previous row is being corrected.

In one exemplary embodiment, LCCS 12 includes a data monitor system 14, a load analysis system 19, and a signal modification system 16. Data monitor system 14 analyzes the pixel data 30 and generates a histogram 35 of all possible pixels values for the row, which includes the number of "occurrences" of each pixel value. For example, in the case of a display having 1200 columns and 256 pixel values, each of the 256 pixel values would receive an occurrence value or rank reflecting how many of the 1200 columns share that value. An exemplary histogram 35 is as follows:

| Pixel Value | Occurrences |
|---|---|
| 0 | 3 |
| 1 | 8 |
| 2 | 0 |
| 3 | 21 |
| . . . | |
| 254 | 50 |
| 255 | 2 |

Thus, it can be seen that a pixel value of "0" will be loaded into three column registers, a pixel value of "1" will be loaded into eight column registers, etc. The histogram reflects the progression of the ramp signal values from the initial value, e.g., 0, to its final value, e.g., 255, and shows where, among other things, significant load changes will occur.

This information is then passed to load analysis system 19. Load analysis system 19 analyzes the data and identifies any error conditions. For instance, if a number of occurrences for a particular pixel value exceed a predetermined "ramp-loading threshold 34," then a severe loading condition can be flagged. Thus, in reference to the above histogram 35, if the ramp loading threshold 34 were predetermined to be "16," then an error condition would be flagged for pixel values 3 and 254. Obviously, the choice of what constitutes an error condition can vary depending on the particular implementation, and all such variations fall within the scope of this invention.

Once the error conditions are identified, they are passed to signal modification system 16, which causes one or more corrections 39 to be applied. In an exemplary embodiment, the type of correction to be applied is determined according to a look-up table (LUT) 32. It should be recognized that the type of correction for each given error condition could be readily pre-designed. For example, with reference to the above histogram, it can be seen that 21 occurrences have a pixel value of "3." Accordingly, it is known that 21 column drivers will switch at the same time, at a known ramp signal level. Because it is known (e.g., via experimentation) that such a situation will result in a specific undesirable transient condition (e.g., a 10 mV drop) in the buffer 26, the appropriate correction can be put into the LUT 32. Namely, the ramp signal at that time can be adjusted to overcome the anticipated voltage drop.

It should be recognized that there are no limitations regarding the factors utilized to make such an adjustment, and all such variations fall within the scope of this invention. For example, the inputs to the look-up table may include: (1) the pixel value; (2) the occurrence of the pixel value; and (3) the location in the row of those pixels having the pixel value. Moreover, the type of correction LUT 32 implements may be base on various factors including: (1) the output impedance of the ramp buffer 26; (2) the load on the ramp buffer 26; (3) the printed circuit board layout impedance effects; and (4) the display layout effects.

It is understood that the systems, functions, mechanisms, methods, and modules described herein can be implemented in hardware, software, or a combination of hardware and software. They may be implemented by any type of computer system or other apparatus adapted for carrying out the methods described herein. A typical combination of hardware and software could be a general-purpose computer system with a computer program that, when loaded and executed, controls the computer system such that it carries out the methods described herein. Alternatively, a specific use computer, containing specialized hardware for carrying out one or more of the functional tasks of the invention could be utilized. The present invention can also be embedded in a computer program product, which comprises all the features enabling the implementation of the methods and functions described herein, and which—when loaded in a computer system—is able to carry out these methods and functions. Computer program, software program, program, program product, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

What is claimed is:

1. A column driver system, comprising:

a plurality of column drivers, each including a register for storing a pixel value;

a column driver circuit having a ramp generator for generating a shared ramp signal for the plurality of column drivers;

a buffer coupled between the ramp generator and the plurality of column drivers; and a load characteristic correction system for adaptively adjusting the shared ramp signal in anticipation of a load error associated with at least one pixel value, the load characteristic correction system including a data monitor adapted to collect pixel data for each of the plurality of column drivers and to determine a number of occurrences of all possible pixel values, and a load analyzer adapted to identify error conditions based on the number of occurrences.

2. The column driver system of claim 1, wherein each of the column drivers comprises:

a comparator for comparing its pixel value to a plurality of values sampled from the shared ramp signal; and a switching mechanism for activating the column driver when the pixel value matches one of the sampled values.

3. The column driver system of claim 2, wherein the load characteristic correction system includes a signal modification system that causes the ramp signal to be altered when an error condition is identified.

4. The column driver system of claim 3, wherein the load analyzer identifies an error condition if the number of occurrences of a pixel value exceeds a predetermined threshold value.

5. The column driver system of claim 4, wherein the predetermined threshold value reflects a number of column drivers that when switched together will cause a severe loading condition.

6. The column driver system of claim 3, wherein the signal modification system includes a look-up table that dictates how to alter the ramp signal.

7. The column driver system of claim 3, wherein the load characteristic correction system determines how to alter the ramp signal prior to loading pixel data into each column driver.

8. The column driver system of claim 7, wherein the load characteristic correction system includes a row buffer for storing a row of pixel data while the load characteristic correction system determines how to alter the ramp signal.

9. A method for driving a plurality of column drivers in an active matrix display, comprising:

loading each of the column drivers with a pixel value selected from a set of possible pixel values;

generating a shared ramp signal for the plurality of column drivers;

sampling the shared ramp signal at a different time for each possible pixel value;

adaptively adjusting the shared ramp signal in anticipation of a load error associated with at least one pixel value, where the adjusting step includes collecting pixel data for each of the plurality of column drivers, determining a number of occurrence of all possible pixel values, and identifying error conditions based on the number of occurrences.

10. The method of claim 9, wherein the adjusting step includes:

altering the ramp signal when an error condition is identified.

11. The method of claim 10, wherein an error condition is identified if the number of occurrences of a pixel value exceeds a predetermined threshold value.

12. The method of claim 11, wherein the predetermined threshold value reflects a number of column drivers that when switched together will cause a severe loading condition.

13. The method of claim 10, wherein a look-up table is used to dictates how to alter the ramp signal.

14. The method of claim 9, wherein the determination of how to alter the ramp signal occurs prior to the step of loading the pixel values into each column driver.

15. A column driver system for driving a plurality of column drivers in an active matrix display, comprising:

a register in each column driver for storing a pixel value selected from a set of possible pixel values;

a system that generates a shared ramp signal for the plurality of column drivers;

a system that samples different values of the shared ramp signal for each possible pixel value; and a load characteristic correction system that adaptively adjusts the shared ramp signal in anticipation of a load error associated with at least one pixel value, the load characteristic correction system including a data collector adapted to collect pixel data for each of the plurality of column drivers and to determine a number of occurrences of all possible pixel values, and a load analyzer adapted to identify error conditions based on the number of occurrences.

16. The column driver system of claim 15, wherein the load characteristic correction system includes a signal modification system that determines a correction to the ramp signal when an error condition is identified.

17. The column driver system of claim 16, wherein the load analyzer identifies an error condition if the number of occurrences of a pixel value exceeds a predetermined threshold value.

18. The column driver system of claim 17, wherein the predetermined threshold value reflects a number of column drivers that when switched together will cause a severe loading condition.

19. The column driver system of claim 16, wherein the signal modification system includes a look-up table that dictates how to alter the ramp signal.

20. The column driver system of claim 16, wherein the load characteristic correction system determines how to alter the ramp signal prior to loading pixel data into each column driver.

21. The column driver system of claim 20, wherein the load characteristic correction system includes a row buffer for storing a row of pixel data while the load characteristic correction system determines how to alter the ramp signal.

* * * * *